US011236763B2

(12) United States Patent
Kosmicki et al.

(10) Patent No.: US 11,236,763 B2
(45) Date of Patent: Feb. 1, 2022

(54) INVERTED ANNULAR SIDE GAP ARRANGEMENT FOR A CENTRIFUGAL PUMP

(71) Applicant: WEIR SLURRY GROUP, INC., Madison, WI (US)

(72) Inventors: Randy J Kosmicki, Edgerton, WI (US); Allen David Russell, Redcliffe (AU)

(73) Assignee: Weir Slurry Group, Inc., Madison, WI (US)

( * ) Notice: Subject to any disclaimer, the term of this patent is extended or adjusted under 35 U.S.C. 154(b) by 0 days.

(21) Appl. No.: 16/621,190

(22) PCT Filed: Aug. 1, 2019

(86) PCT No.: PCT/US2019/044737

§ 371 (c)(1),
(2) Date: Dec. 10, 2019

(87) PCT Pub. No.: WO2020/028712

PCT Pub. Date: Feb. 6, 2020

(65) Prior Publication Data

US 2021/0003144 A1 Jan. 7, 2021

Related U.S. Application Data

(60) Provisional application No. 62/713,192, filed on Aug. 1, 2018.

(51) Int. Cl.

| | |
|---|---|
| ***F04D 29/42*** | (2006.01) |
| ***F04D 29/22*** | (2006.01) |
| ***F04D 29/44*** | (2006.01) |

(52) U.S. Cl.
CPC ..... *F04D 29/4293* (2013.01); *F04D 29/22* (2013.01); *F04D 29/426* (2013.01); *F04D 29/4286* (2013.01); *F04D 29/44* (2013.01)

(58) Field of Classification Search
CPC ..... F04D 29/167; F04D 7/04; F04D 29/22; F04D 1/04; F04D 29/026; F04D 29/24;
(Continued)

(56) References Cited

U.S. PATENT DOCUMENTS 4,236,867 A * 12/1980 Morris ..... F01D 11/04 415/110
4,655,684 A * 4/1987 Haentjens ..... F04D 29/126 415/170.1

(Continued)

*Primary Examiner* — Dominick L Plakkoottam
(74) *Attorney, Agent, or Firm* — Morriss O'Bryant; Compagni Cannon, PLLC.

(57) ABSTRACT

Various aspects of the disclosure are directed to providing structures that define a radial gap between an impeller and a pump casing element that facilitates minimizing the movement of fluid into the radial gap in a manner that lessens the impact, and consequent degradation, of the inner surface of the pump casing element by movement of abrasive particulates out of the radial gap, which is accomplished by providing a suction inlet arrangement of an impeller and pump casing element that are angled from the eye of the impeller to the outer periphery of the impeller in a direction away from the back shroud or drive side of the impeller and toward a first end of the pump casing in which fluid is introduced into the pump casing.

15 Claims, 10 Drawing Sheets

(58) Field of Classification Search
CPC .. F04D 29/242; F04D 29/426; F04D 29/4293; F04D 29/44
See application file for complete search history.

(56) References Cited

U.S. PATENT DOCUMENTS

| | | | | | |
|---|---|---|---|---|---|
| 4,687,412 | A * | 8/1987 | Chamberlain | F04D 29/4206 | 415/134 |
| 5,411,367 | A * | 5/1995 | Walker | F04D 29/167 | 415/170.1 |
| 5,921,748 | A * | 7/1999 | Frater | F04D 29/167 | 415/172.1 |
| 5,941,536 | A * | 8/1999 | Hill | F04D 29/622 | 277/634 |
| 6,098,422 | A * | 8/2000 | Tischer | F04D 29/2277 | 417/366 |
| 6,106,230 | A * | 8/2000 | Burgess | F04D 7/04 | 415/196 |
| 6,951,445 | B2 | 10/2005 | Burgess | | |
| 7,470,106 | B1 * | 12/2008 | Blattmann | F04D 7/045 | 415/196 |
| 8,608,445 | B2 | 12/2013 | Burgess | | |
| 9,004,869 | B2 * | 4/2015 | Burgess | F04D 29/2255 | 416/186 R |
| 2007/0160465 | A1 | 7/2007 | Roudnev et al. | | |
| 2013/0202426 | A1 | 8/2013 | Walker | | |
| 2014/0241888 | A1 * | 8/2014 | Lavagna | F04D 29/426 | 416/186 R |
| 2016/0040682 | A1 * | 2/2016 | Walker | F04D 29/24 | 416/185 |

* cited by examiner

INVERTED ANNULAR SIDE GAP ARRANGEMENT FOR A CENTRIFUGAL PUMP

TECHNICAL FIELD

This disclosure relates in general to centrifugal pumps and, in particular, to an improved impeller and side liner interface arrangement for and in a centrifugal pump, which improves the wear characteristics of the suction side of the pump casing and side liner, especially when pumping abrasive slurries.

BACKGROUND OF THE DISCLOSURE

Centrifugal pumps are well known and widely used in a variety of industries to pump fluids or liquid and solid mixtures. The general components of a centrifugal pump include a collector, also known as a volute, having an inner disposed chamber in which an impeller rotates. The pump has a suction inlet through which fluid enters into the collector via the impeller, and a discharge outlet for egress of fluid from the pump. The impeller is connected to a drive mechanism that causes rotation of the impeller within the pump casing. The pump casing is comprised of the collector and may incorporate the side liner, or the side liner may be a separate piece.

The impeller has one or more main pumping vanes that accelerate fluid entering into the impeller in a circumferential and radial direction, discharging fluid into the collector or volute of the pump. Hydrodynamic forces imposed on the fluid by the rotating vanes of the impeller cause the fluid to move radially outwardly and cause a pressure differential to form, such that there is lower pressure near or at the eye of the impeller and higher pressure at the radial portions or outer circumference of the impeller.

The pressure differential or pressure gradient causes fluid at the periphery of the impeller to recirculate toward the low pressure area of the impeller near the center or eye. This recirculation of fluid takes place in the radial gap that exists between the impeller and the stationary inner surface of the sides of the pump casing which are adjacent the impeller. Recirculation, otherwise characterized as internal leakage, can take place both on the back side (i.e., drive side) of the impeller and on the front side (i.e., suction side) of the impeller. Leakage of fluid into the radial gap causes loss of pump performance. Additionally, when fluids with entrained solids are being pumped, the abrasive particulates cause wear on the sides of the pump casing as recirculating slurry moves into and out of the radial gap.

In recognition of this problem, various solutions have been proposed, including providing the surface of one or both impeller shrouds with expeller vanes that are positioned in and along the radial gap. The expeller vanes accelerate the fluid and solids that leak into the radial gap in a tangential direction. Centrifugal force then directs the solids away from the low pressure area of the impeller toward the peripheral areas of the impeller and back into the collector. Expeller vanes may be provided on both the front shroud and rear shroud of an impeller.

With the spinning of fluid in the radial gap between the impeller and the side of the pump casing, the acceleration of the fluid increases the pressure at the periphery of the impeller in the side gap, reducing the pressure differential between the area at the outlet of the impeller and the area adjacent the side gap, and subsequently, reducing the internal leakage. Meridional velocity of the fluid between the expeller vanes is toward the impeller periphery. Meridional velocity, with respect to turbomachinery, is the component of fluid velocity at the meridional plane, which is a plane passing through the axis of rotation of an impeller. Meridional velocity of the fluid near the inner surface of the side of the pump casing in the radial gap is towards the inlet due to the driving pressure difference between the central region of the impeller and the periphery of the impeller.

Particulates in the radial gap may be purged by the expeller vanes if the centrifugal force is greater than the fluid drag force that operates to move the particulates into the radial gap with recirculation. Larger particles are impacted by the expeller vanes and are accelerated circumferentially and thus outwardly as a result of centrifugal force. Smaller particles entrained in the fluid primarily follow the fluid flow in the radial gap. Although expeller vanes provide some beneficial effect in moving the particulates out of the radial gap, the increase in particle velocity, relative to the stationary side liners, caused by the expeller vanes can increase the wear that occurs on the inner surface of the pump casing in the radial gap.

The effect of particulate movement in the radial gap is further influenced by the configuration of the impeller and the side of the pump casing that is adjacent the impeller, or that area defined as the radial gap. Impellers for centrifugal pumps that include one or more shrouds may be configured with shrouds that are planar. That is, the surface of the shroud lies in a plane that is perpendicular to the rotational axis of the impeller. Examples of such impellers are disclosed in, for example, U.S. Pat. No. 8,608,445 to Burgess and U.S. App. No. 2013/0202426 to Walker. The planar radial gap geometry that results in such impeller configurations allows the fluid in the radial gap to be directed substantially in a circumferential and radial direction by expeller vanes. However, due to the complex nature of the flow, damage to the side of the pump casing from particulate matter in planar radial gap geometries persists as a result of solids impacting the stationary wall.

Other common impeller geometries are those having a front shroud that is curved, and the side of the pump casing is similarly curved. Examples of such curved gap geometries are disclosed, for example, in U.S. Pat. No. 4,802,817 to Tyler. Other impeller configurations include those where the front shroud surface is conically shaped, with a similar conically-shaped inner surface of the pump casing side. Examples of such pump configurations are disclosed in, for example, U.S. Pat. No. 6,951,445 to Burgess and U.S. Pat. No. 8,834,101 to Minnot. In these configurations, a curved or conically-shaped radial gap is present, and fluid that leaks into the radial gap is directed, under hydrodynamic forces imposed by the impeller, to strike the inner surface of the side of the pump casing in the radial gap. Wear on the inner surface of the pump casing, or on the suction side liner, as shown in the '445 patent, for example, results and can be substantially more pronounced than with planar gap geometries. Those configurations are more commonly used in processing clear fluids (i.e., fluids with no entrained solids) because they allow for optimizing of the flow into the main pumping vanes, but are not beneficial for use in processing abrasive slurries due to the potential increase in wear on the pump casing or side liner.

A radial gap geometry that reduces the wear on the inner surface of the pump casing, or side component of the pump, would be beneficial in the pump industry for processing abrasive slurries.

SUMMARY

In a first aspect, embodiments are disclosed of a suction inlet arrangement for a centrifugal pump comprising a fluid inlet body including an axially extending fluid conduit having a first end with a first opening for introduction of fluid into the conduit and a second end with a second opening, a fluid pathway being defined between the first end and the second end, and a radially extending wall that extends radially outwardly from the second end of the fluid inlet body to an outer radial point, the radially extending wall having an annular surface that faces outwardly in a direction away from the first end of the fluid inlet body and which slopes in a direction from the second end of the fluid conduit toward the outer radial point, the direction of the slope being oriented toward the first end of the fluid inlet conduit, and an impeller having a rear shroud and a front shroud axially spaced from the rear shroud, the front shroud having a circumferential opening defining an eye of the impeller and having an annular peripheral aspect radially spaced from the eye, the front shroud having an outward facing surface that extends from the circumferential opening to the peripheral aspect of the front shroud in a direction away from the rear shroud, the outward facing surface of the front shroud being positioned adjacent to the radially extending wall of the fluid inlet body and being angled at approximately the same degree of slope as the angle of slope of the radially extending wall of the fluid inlet body. This aspect of the disclosure is advantageous over conventional impeller and side liner arrangements, or radial gap geometries, in being configured to direct abrasive particles away from the outward facing surface of the pump or side liners which surrounds the inlet, and thereby prolong the wear life of the pump at the area of the radial gap.

In certain embodiments, the angle of slope of the radially extending wall, as measured between a first plane in which the second end of the fluid inlet body lies and a second plane in which all or part of the radially extending wall lies, is between two degrees and twenty degrees, the first plane being oriented perpendicular to the rotational axis of the impeller.

In other certain embodiments, the angle of slope of the radially extending wall is between four degrees and eighteen degrees.

In yet another embodiment, the angle of slope of the radially extending wall is between five degrees and fifteen degrees.

In still another embodiment, the angle of slope of the radially extending wall is between six degrees and sixteen degrees.

In other embodiments, the angle of slope of the radially extending wall is between eight degrees and fourteen degrees.

In yet other embodiments, the angle of slope of the radially extending wall is between ten degrees and twelve degrees.

In certain embodiments, the outward facing surface of the front shroud of the impeller further includes at least one expeller vane.

In some embodiments, the impeller has an annular ring-shaped base surrounding the circumferential opening, the ring-shaped base extending from the circumferential opening to a circular facet defining the ring-shaped base.

In certain embodiments, the ring-shaped base is angled in a direction from the circumferential opening toward the circular facet, the slope of direction being toward the radially extending wall of the fluid inlet body.

In other embodiments, the ring-shaped based is planar, lying in a plane that is perpendicular to the rotational axis of the impeller.

In some embodiments, the slope of the radially extending wall begins and extends from a point of the wall that is radially aligned with the circular facet of the ring-shaped base of the impeller toward the outer radial point of the radially extending wall.

In yet other embodiments, the slope of the radially extending wall begins at the second end of the fluid inlet body and extends to the outer radial point of the radially extending wall.

In still other embodiments, the fluid inlet body is a suction side liner or throatbush.

In yet other embodiments, the fluid inlet body is a side liner component of a pump casing.

In a second aspect, an impeller for use in a centrifugal pump includes a hub configured to be connected to a drive mechanism, a rear shroud positioned for orientation toward the drive side of a pump, the rear shroud having a peripheral aspect positioned radially apart from the hub, a front shroud axially spaced from the rear shroud and positioned for orientation toward the suction side of a pump, the front shroud having a circumferential opening with an edge defining an eye of the impeller and having an annular peripheral aspect radially spaced from the eye, at least one pumping vane extending axially between the rear shroud and the front shroud and extending generally radially from proximate the eye to the periphery of the front shroud and/or back shroud, wherein the front shroud has an outward facing surface configured to be positioned toward a portion of a pump fluid inlet, the outward facing surface extending from at or near the circumferential opening of the front shroud to the peripheral aspect of the front shroud at an angle that slopes in a direction from the circumferential opening to the peripheral aspect of the front shroud, the direction of the slope being away from the hub. The impeller of this aspect is advantageous in being configured to direct fluid along the front shroud in a manner that lessens the impact of abrasive particles against the inner surface of an adjacent portion of the pump casing in a radial gap defined therebetween.

In certain embodiments, the angle of slope of the outward facing surface of the front shroud, as measured from a first plane in which the circumferential opening of the eye of the impeller lies and a second plane in which some or all of the outward facing surface lies, is between two degrees and twenty degrees.

In other embodiments, the angle of slope of the outward facing surface of the front shroud is between four degrees and eighteen degrees.

In still other embodiments, the angle of slope of the outward facing surface of the front shroud is between five degrees and fifteen degrees.

In yet other embodiments, the angle of slope of the outward facing surface of the front shroud is between six degrees and sixteen degrees.

In certain other embodiments, the angle of slope of the outward facing surface of the front shroud is between eight degrees and fourteen degrees.

In other embodiments, the angle of slope of the outward facing surface of the front shroud is between ten degrees and twelve degrees.

In certain embodiments, the outward facing surface is configured with at least one expeller vane.

In still other embodiments, the at least one pumping vane further comprises a plurality of pumping vanes.

In a third aspect, a pump casing element for a centrifugal pump comprises a fluid inlet conduit having a first end with a first opening for introduction of fluid into the conduit and a second end with a second opening for delivery of fluid to an impeller, a fluid pathway being provided between the first end and the second end, and a radially extending wall that extends radially outwardly from the second end of the fluid inlet conduit and extends from the second end of the fluid inlet conduit to an outer radial point of the radially extending wall, the radially extending wall having an annular surface that faces outwardly in a direction that is oriented away from the first end of the fluid inlet conduit and which slopes in a direction from the second end of the fluid conduit to the outer radial point, the direction of the slope being toward the first end of the fluid inlet conduit. The pump casing element of this aspect provides an advantage over conventional pump configurations in being configured to direct fluid along the annular surface of the pump casing element in a manner that lessens degradation of the annular surface by abrasive particulates.

In certain embodiments, the angle of slope of the radially extending wall, as measured between a first plane in which the second end of the fluid inlet conduit lies and a second plane in which all of some of the radially extending wall lies, is between two degrees and twenty degrees.

In other embodiments, the angle of slope of the radially extending wall is between four degrees and eighteen degrees.

In some embodiments, the angle of slope of the radially extending wall is between five degrees and fifteen degrees.

In yet other embodiments, the angle of slope of the radially extending wall is between six degrees and sixteen degrees.

In still other embodiments, the angle of slope of the radially extending wall is between eight degrees and fourteen degrees.

In certain other embodiments, the angle of slope of the radially extending wall is between ten degrees and twelve degrees.

In certain embodiments, the fluid inlet conduit and radially extending wall are portions of a pump casing side of a centrifugal pump.

In still other embodiments, the fluid inlet conduit and radially extending wall are elements of a throatbush component for a centrifugal pump.

In some embodiments, the fluid inlet conduit and radially extending wall are components of a side liner for a centrifugal pump.

In other embodiments, the fluid inlet conduit and radially extending wall are components of an elastomeric wear member structured for positioning against the suction inlet of a centrifugal pump.

In a fourth aspect, a centrifugal pump comprises a pump casing having a drive side and a suction side, the joinder of which define a pump chamber, an impeller configured for attachment to a drive mechanism and being rotatably received in the pump chamber, the impeller having a rear shroud and a front shroud, the front shroud having a circumferential opening defining the eye of the impeller and having an outer peripheral aspect radially spaced from the circumferential opening, the front shroud having an annular outward facing surface oriented toward the suction side of the pump casing, the annular outward facing surface being angled in a direction from the circumferential opening of the eye to the annular peripheral aspect, the direction of the angle being toward the suction side of the pump casing, and a fluid inlet positioned at the suction side of the pump casing and having a conduit having a first end with a first opening for introduction of fluid into the conduit and a second end with a second opening for delivery of fluid to the eye of the impeller, and further having a radially extending wall that extends radially outwardly from the second end of the conduit, and extends from the second opening of the conduit to an outer radial point of the wall, the radially extending wall having an annular surface that faces outwardly in a direction that is oriented toward the impeller and which slopes in a direction from the second end of the fluid conduit to the outer radial point of the wall, the direction of the slope being toward the first end of the conduit. This aspect of the disclosure provides a pump having a radial gap geometry that lessens wear on the pump casing or side liner of the pump.

In certain embodiments, the angle of slope of the annular surface of the radially extending wall is between two and twenty degrees.

Other aspects, features, and advantages will become apparent from the following detailed description when taken in conjunction with the accompanying drawings, which are a part of this disclosure and which illustrate, by way of example, principles of the inventions disclosed.

DESCRIPTION OF THE FIGURES

The accompanying drawings facilitate an understanding of the various embodiments.

DETAILED DESCRIPTION

Figure 1:
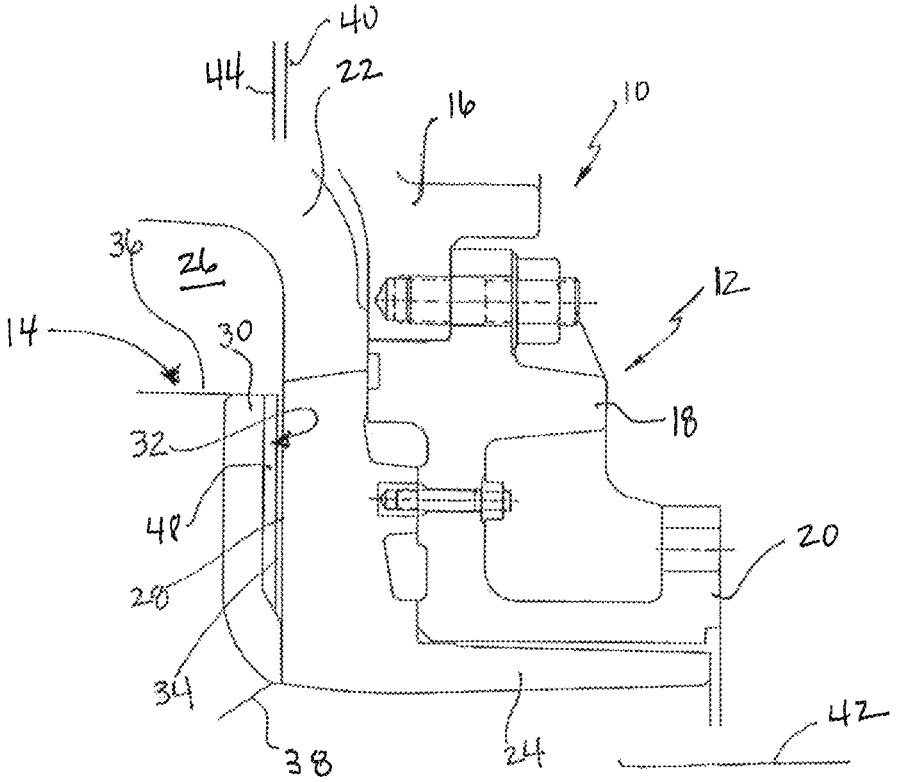
FIG. 1 (prior art)
FIG. 1 is a partial cross sectional view of one configuration of a conventional pump suction inlet and radial gap geometry.
Figure 2:
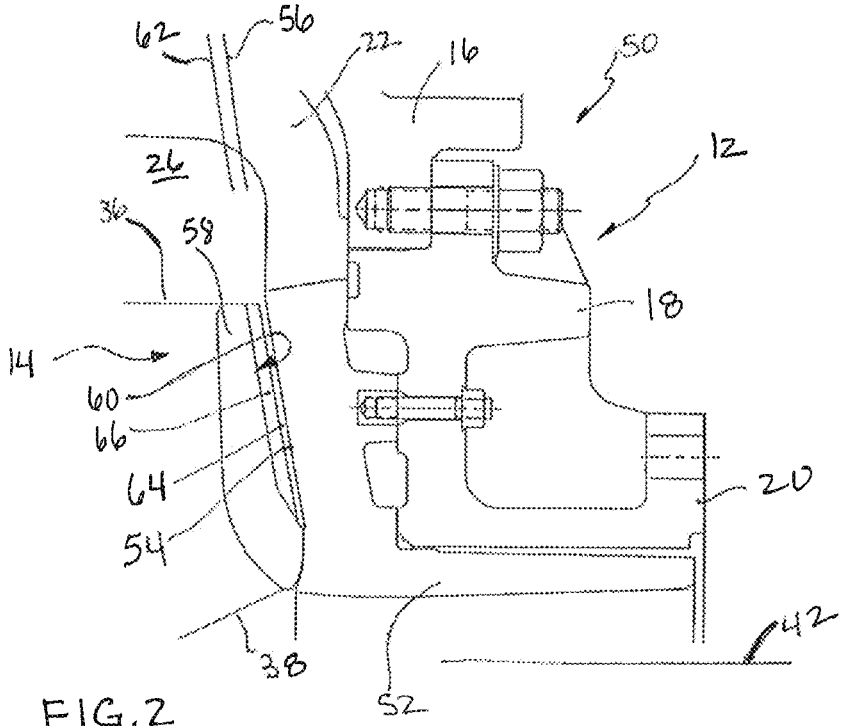
FIG. 2 (prior art)
FIG. 2 is a partial cross sectional view of another configuration of a conventional pump suction inlet and radial gap geometry.

The various aspects of the disclosure are directed to providing structures that define a radial gap between an impeller and a pump casing element that facilitates the movement of leaked or recirculated fluid out of the radial gap in a manner that lessens the impact on, and consequent degradation of, the inner surface of the pump casing element. FIGS. 1 and 2 provide comparative views of conventional pump arrangements which will aid in the understanding of the present disclosure.

FIG. 1 illustrates certain features of a conventional centrifugal pump 10, including the pump casing 12 and impeller 14. These basic elements of a centrifugal pump are well-known in the art and are not illustrated or described in detail for that reason. However, for the sake of clarity, it is noted that the pump casing 12 illustrated in FIG. 1 is comprised of a volute casing 16 and an end casing 18. The end casing 18 is that of the suction side of the pump and, therefore, is configured with an inlet 20. A volute pump liner 22 is shown positioned within the volute casing 16, and the inlet of the end casing 18 is fitted with a throatbush 24. The volute liner 22 and throatbush 24, in part, define a pump chamber 26 within which the impeller 14 rotates. The volute liner 22 and throatbush 24 of this type of arrangement are made of elastomer material or other suitable material. The construction of centrifugal pumps varies widely, and the inclusion and arrangement of the illustrated pump elements is by way of example only.

The throatbush 24 shown in FIG. 1 has an inner annular surface 28 that is positioned adjacent the impeller 14. The impeller 14 has a front shroud 30 that has a radially extending annular surface 32 which is positioned adjacent to the inner surface 28 of the throatbush 24. A radial gap 34 exists between the radially extending annular surface 32 and the inner annular surface 28. As is known and described previously herein, rotation of the impeller 14 causes an increase in pressure due to centrifugal forces which creates a pressure differential between the higher pressure at the outer circumference or periphery 36 of the impeller and the lower pressure at the eye 38 of the impeller 14. Consequently, fluid at the periphery 36 of the impeller is caused to recirculate or leak into the radial gap 34 from the periphery 36 toward the eye 38 of the impeller 14.

In a conventional pump of the type shown in FIG. 1, the inner surface 28 of the throatbush 24 is planar; that is, the inner surface 28 lies in a plane 40 that is perpendicular to the rotational axis 42 of the impeller. Likewise, the radially extending surface 32 of the front shroud 30 of the impeller 14 is planar and lies in a plane 44 that is perpendicular to the rotational axis 42 of the impeller 14. A planar radial gap geometry is, thus, provided. In a planar radial gap geometry, when fluid that has recirculated or leaked into the radial gap 34 is contacted by expeller vanes 48 positioned on the radially extending annular surface 32 of the front shroud 30 of the impeller 14, the fluid is subjected to hydrodynamic forces which cause abrasive particulates in the fluid to strike the inner surface 28 of the throatbush 24 as they are expelled out of the radial gap 34. Wear on the inner annular surface 28 of the pump casing part results.

FIG. 2 illustrates another conventional pump arrangement, like elements of which are denoted with the same reference numerals. The conventional pump 50 of FIG. 2 includes the same elements of a pump casing 12 and an impeller 14. However, in this pump arrangement, the throatbush 52 has an inner surface 54 that is obtusely angled relative to the rotational axis 42 of the impeller 14. That is, the inner, radially-extending annular surface 54 of the throatbush 52 lies in a plane 56 that is angled in a direction away from the inlet 20 of the end casing 18 such that the angle between the rotational axis 42 extending through the throatbush 52 and the plane 56 is greater than 90°. The impeller 14 is likewise configured with a front shroud 58 that has a radially extending annular surface 60 which lies in a plane 62 that is obtusely angled relative to the rotational axis 42 extending through the throatbush 52 in a direction away from the inlet 20 of the end casing 18. A radial gap 64 is formed between the inner surface 54 of the throatbush 52 and the radially extending surface 60 of the front shroud 58 of the impeller 14, the radial gap 64 having an obtusely angled geometry relative to the rotational axis 42 extending through the throatbush.

In the conventional pump of FIG. 2, when fluid recirculates or leaks into the radial gap 64, and is then urged outwardly due to contact of particulates with the expeller vanes 66 on the front shroud 58, the fluid vortices and meridional velocities imposed on the fluid propel the abrasive particulates in the fluid into the inner surface 54 of the throatbush 52 causing wear of the inner surface 54 thereof. Notably, this type of pump is more typically used in processing clear fluids due to the increased potential for significant wear on the inner surface 54 of the throatbush 52 when used to process slurries.

Figure 3:
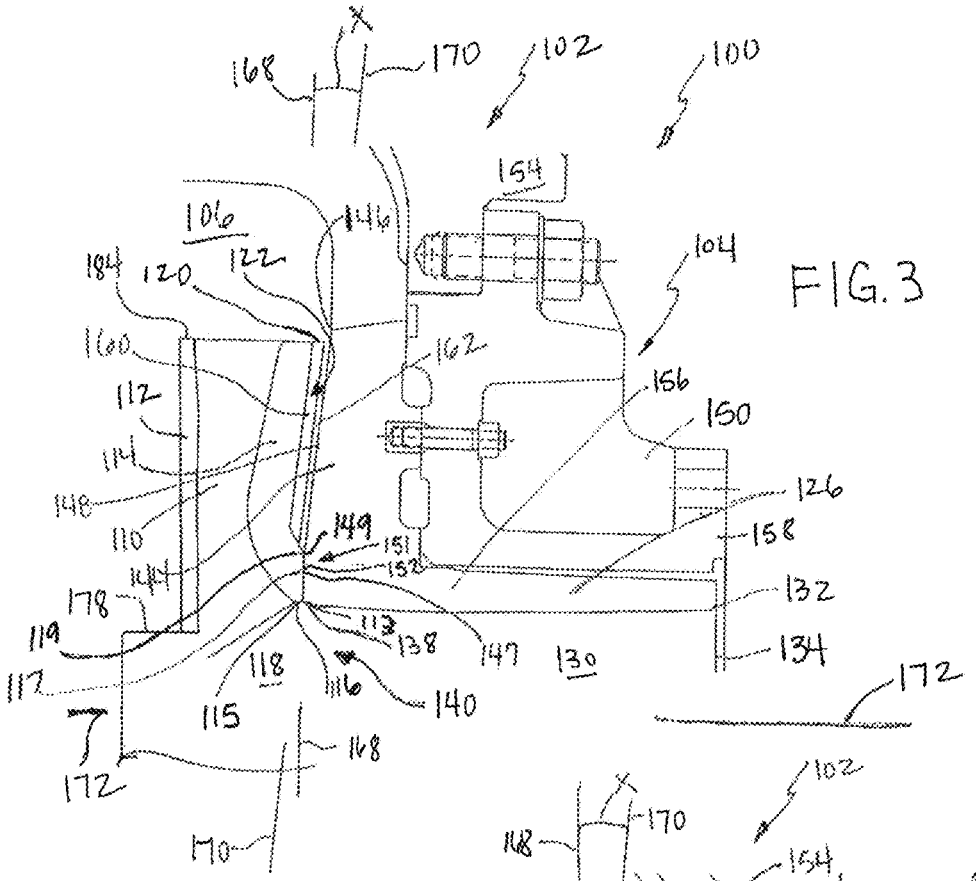
FIG. 3 is a partial cross sectional view of a configuration of a pump suction inlet and radial gap geometry in accordance with this disclosure.

FIG. 3 illustrates a centrifugal pump 100 in accordance with one aspect of the present disclosure. The centrifugal pump 100 includes a pump casing 102 having a drive side (not shown) and a suction side 104, the joinder of which generally defines a pump chamber 106. An impeller 110 is configured for attachment to a drive mechanism (not shown) and is rotatably received in the pump chamber 106. The impeller 110 has a rear shroud 112 and a front shroud 114, the front shroud 114 having a circumferential opening 116 with an edge 115 defining or encircling the eye 118 of the impeller 110. In the embodiment of FIG. 3, an annular ring-shaped base 117 surrounds the circumferential opening 116 and extends radially from the edge 115 of the circumferential opening 116 to a circular facet 119 that defines the outer boundary of the ring-shaped base 117. An impeller falling with the scope of this disclosure need not be configured with a ring-shaped base as described.

The impeller 110 also has an outer peripheral aspect 120 that is radially spaced from the circumferential opening 116. The front shroud 114 has an annular outward facing surface 122 that is oriented toward the suction side 104 of the pump casing 102. The annular outward facing surface 122 of the impeller 110 is angled, as measured from the circular facet 119 of the annular ring-shaped base 117 to peripheral aspect 120 of the impeller 110 at the outward facing surface 122. The direction of the angle is oriented toward the suction side 104 of the pump casing 102 and in a direction away from the back shroud 112. In other words, the axial distance between the circular facet 119 and back shroud is less than the axial distance between the peripheral aspect 120 of the front shroud 114 and back shroud 112.

Notably, in certain other embodiments of the disclosure, the angle of the outward facing surface 122 of the front shroud 114 is measured from the circumferential opening 116 of the eye 118 to the peripheral aspect 120 of the impeller 110 at the outward facing surface. The direction of the angle is oriented toward the suction side 104 of the pump casing 102.

The centrifugal pump 100 further includes a fluid inlet 126 positioned at the suction side 104 of the pump casing 102. The fluid inlet 126 provides a conduit 130 having a first end 132 and a first opening 134 for introduction of fluid into the conduit 130 and having a second end 138 with a second opening 140 for delivery of fluid to the eye 118 of the impeller 110. The fluid inlet 126 has a radially extending annular wall 144 that extends generally radially outwardly from the second end 138 of the conduit 130. The radially extending wall 144 extends from the second end 138 of the conduit 130 to an outer radial point 146 of the casing 102 at the radially extending annular wall 144. The radially extending wall 144 has an annular surface 148 that faces in a direction away from the first end 132 of the conduit 130 and slopes in a direction from the second end 138 of the fluid conduit 130 to the outer radial point 146 of the wall 144, the direction of the slope being oriented toward the first end 132 of the conduit 130, or away from the position of the rear shroud 112. That is, the second end 138 of the conduit 130 is located at an axial position, relative to the first opening 134, that is greater than the axial position of the outer radial point 146 relative to the first opening 134.

In the embodiment of FIG. 3, the annular surface 148 of the radially extending wall 144 is configured with an annular portion 147 surrounding the second opening 140 of the fluid inlet 126 and which extends from the second end 138 or second opening 140 of the fluid inlet 126 to a boundary point 149 which is in substantial radial alignment with the circular facet 119 of the ring-shaped base 117 of the impeller 110. By "substantially" is meant that the radial position of the boundary point 149, which encircles the second opening 140 and defines the outer boundary of the annular portion 47, relative to the radial position of the circular facet 119, can vary between 0.01 and 2.0 centimeters, depending on the size of the pump in which the suction inlet arrangement is installed or incorporated.

The annular ring-shaped base 117 and annular portion 147, which are axially adjacent to each other and are spaced apart from each other, may be referred to as a seal dam 151, having a seal dam gap 152 located therebetween. As shown in FIG. 3, the seal dam 151 and the seal dam gap 152 are angled and present an acute angle relative to the longitudinal or rotational axis 172 at the point of its extension through the fluid inlet conduit 126. However, the angle of the seal dam gap 152 is greater than the slope of the portion of the radially extending wall 144 that extends from the boundary point 149 to the outer radial point 146.

Figure 3A:
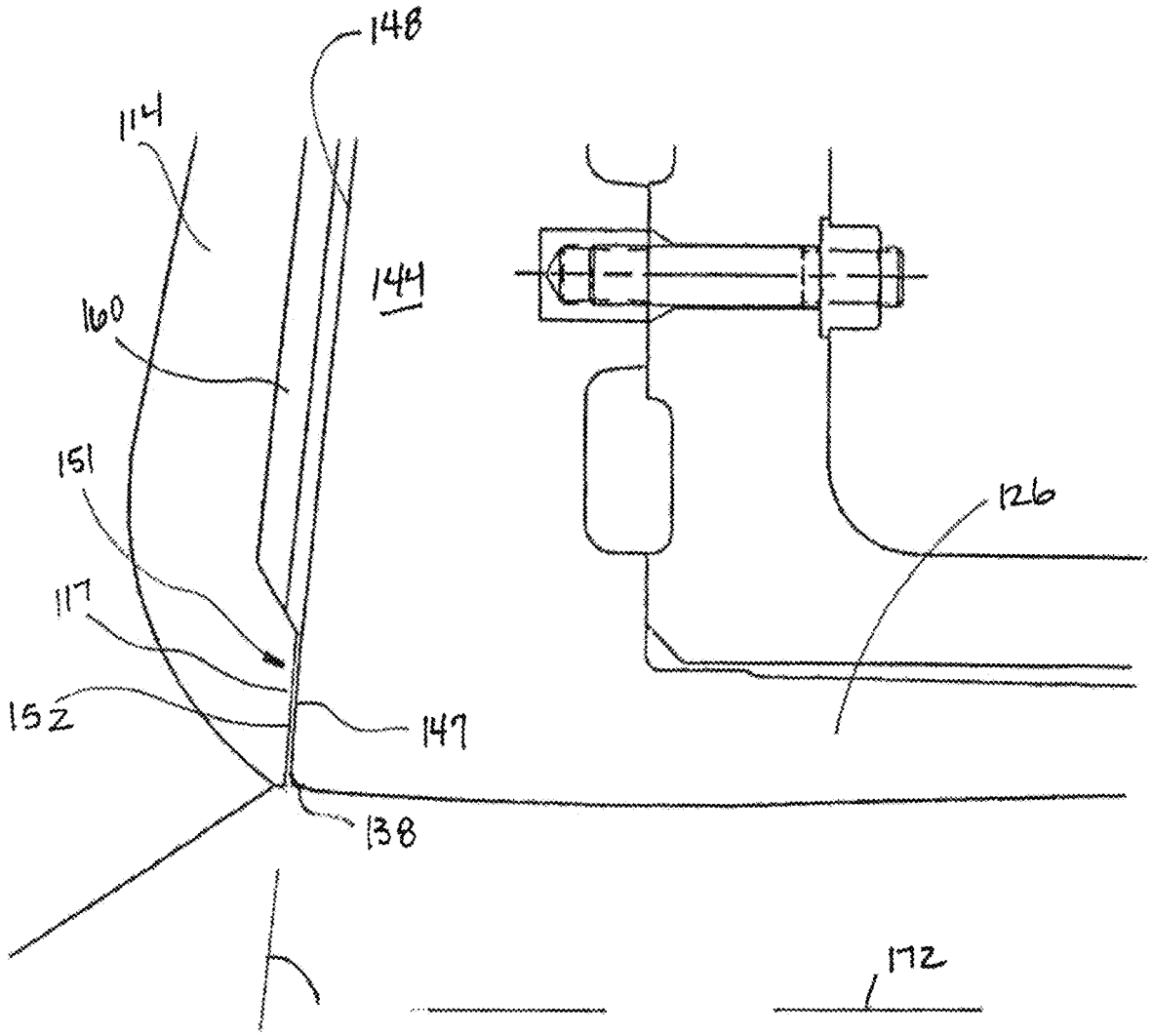
FIG. 3A is an enlarge view of a partial cross section of the impeller and fluid inlet body depicting a further embodiment thereof.

In a further embodiment of the disclosure shown in FIG. 3A, the seal dam 151 and seal dam gap 152 are positioned at an angle that is equivalent to the slope of the annular surface 148, as measured from the second end 138 of the fluid inlet 126 to the outer radial point 146 of the annular surface 148 of the radially extending wall 144. Consequently, the seal dam gap 151 is positioned at the same angle or slope as that of the annular surface 148.

Figure 11:
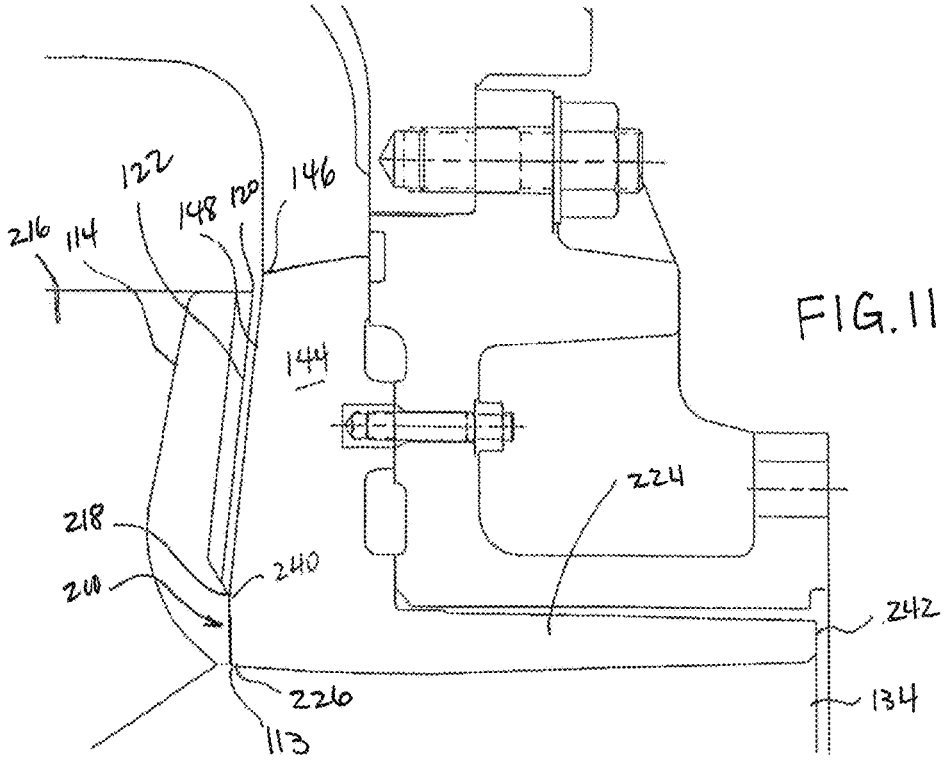
FIG. 11 is a partial view in cross section of another embodiment of the suction inlet arrangement in accordance with the disclosure.
Figure 12:
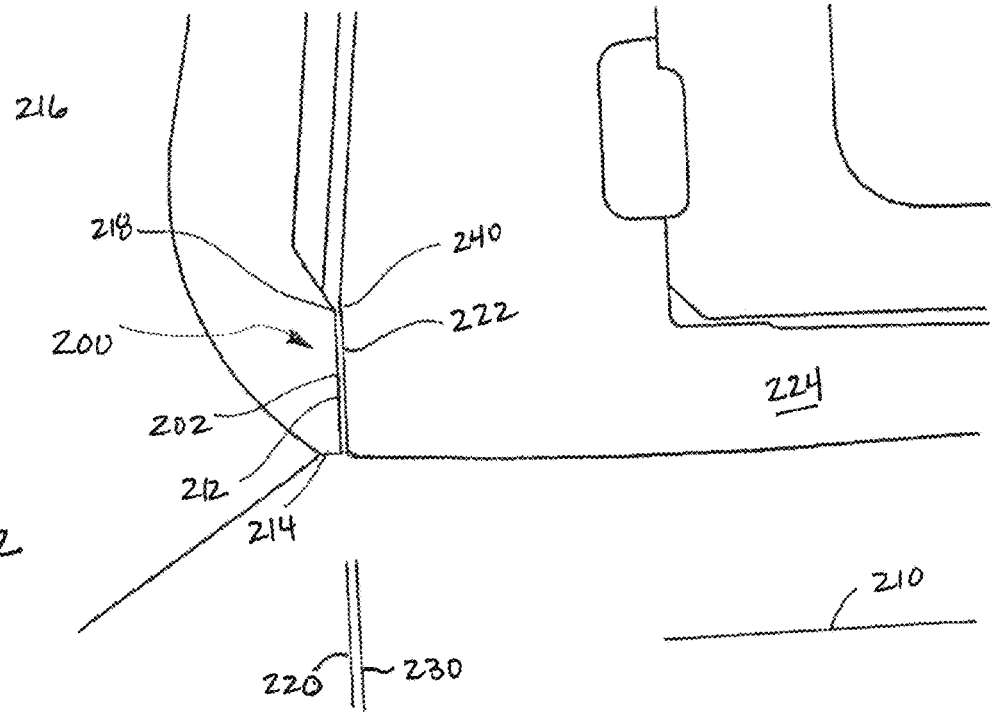
FIG. 12 is an enlarged view of the seal dam and gap shown in FIG. 11.

In a further embodiment of the suction inlet arrangement shown in FIGS. 11 and 12, the seal dam 200 and seal gap 202 are aligned perpendicular to the longitudinal or rotational axis 210. That is, the annular ring-shaped base 212 which surrounds the eye 214 of the impeller 216 is planar and lies in a plane 220 which is perpendicular to the longitudinal or rotational axis 210. Likewise, the annular portion 222 of the fluid inlet 224 surrounding the second end 226 of the fluid inlet is planar and lies in a plane 230 that is parallel to the plane 220 in which the annular ring-shaped base 212 lies. Consequently, the seal gap 202 is perpendicular to the longitudinal or rotational axis 210. In this embodiment, the outward facing surface 122 of the front shroud 114 is angled, from the circular facet 218 of the annular ring-shaped base 212 to the outer peripheral aspect 120 of the front shroud, as previously described herein. That portion of the outward facing surface 148 of the radially extending annular wall 144 that extends from the boundary point 240 of the annular portion 222 to the outer radial point 146 of the outward facing surface 148 has a slope that is directed toward the first end 242 of the fluid inlet 224 as previously described.

In FIG. 3, the pump casing 102 is shown as having an end casing 150 connected to a volute casing 154, and that the fluid inlet 126 is a throatbush 156 that is positioned within the inlet 158 of the end casing 150. FIG. 3 illustrates but one possible aggregation and arrangement of pump casing components. Construction and configuration of centrifugal pumps varies and different arrangements of pump casing elements are within the scope of the disclosure.

As used herein, the term "fluid inlet," "fluid inlet conduit" or "fluid inlet body" refers to any pump casing part, portion or component that comprises a construction providing a fluid pathway into the pump and into the impeller. Consequently, for example, the terms "fluid inlet," "fluid inlet conduit" or "fluid inlet body" may be a cast pump casing side part that comprises one half of the entire pump casing; or may be an end casing comprising the suction side casing; or may be a component throatbush, as shown in FIG. 3; or may be a wear element, such as a side liner, that is positioned within an outer casing part and which provides, in part, a portion of the pump chamber construct. For ease of description, reference herein to a "fluid inlet," "fluid inlet conduit" or "fluid inlet body" element is illustrated and described as a throatbush or side liner, without limitation or disclaimer of equivalent structures that may be employed.

Figure 4:
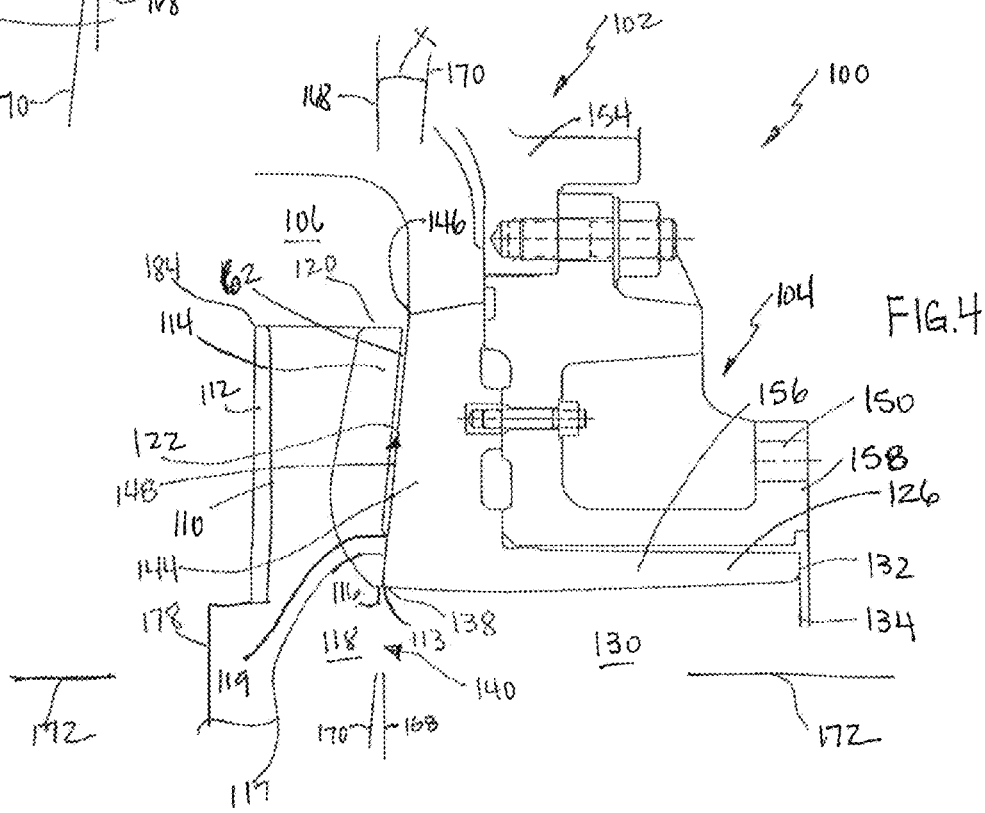
FIG. 4 is a partial cross sectional view of another configuration of a pump suction inlet and radial gap geometry in accordance with this disclosure.
Figure 5:
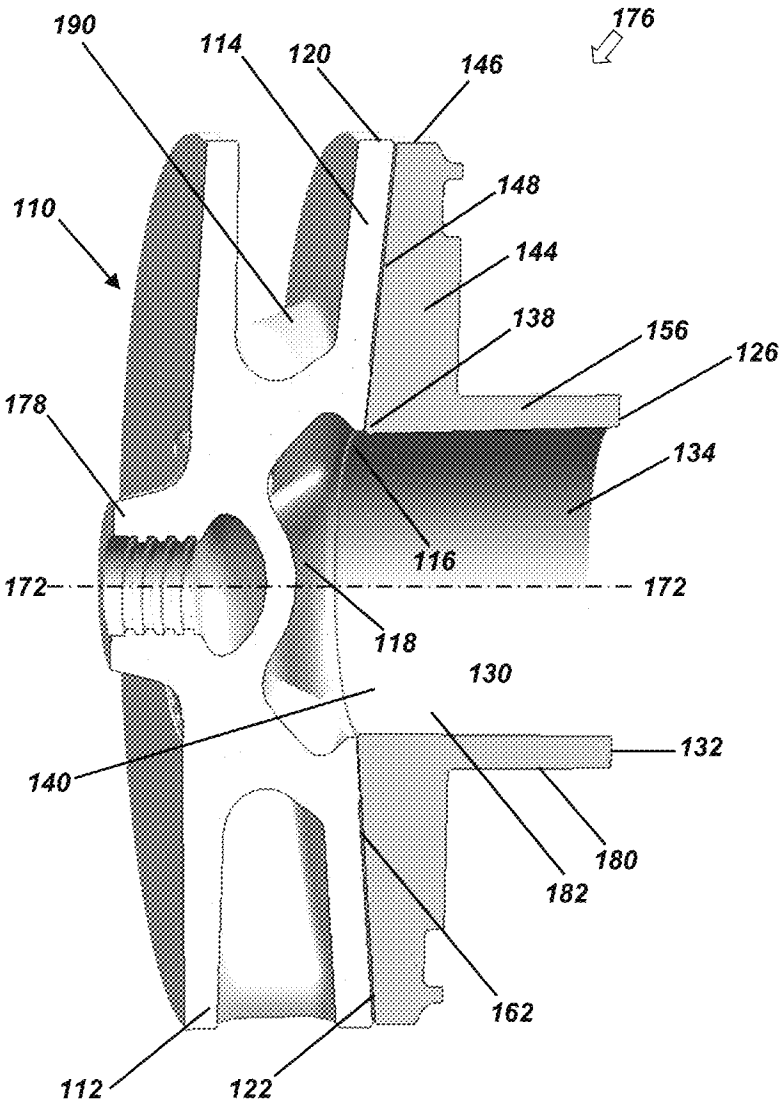
FIG. 5 is an orthographic view in cross section of an embodiment of the radial gap shown in FIG. 4.

In accordance with one embodiment, the impeller 110 may have at least one expeller vane 160, as shown in FIG. 3, positioned along the front shroud 114. The arrangement of one or more expeller vanes 160 on the front shroud 114 may best be seen in the suction inlet arrangement illustrated in FIGS. 6 and 7, and in the impeller 110 shown in FIG. 8. Alternatively, as shown in FIGS. 4 and 5, the impeller 110 may be configured without expeller vanes on the front shroud 114. Although not shown, the impeller 110 may or may not be configured with expeller vanes on the rear shroud 112.

In accordance with the disclosure, the radially extending annular wall 144 of the fluid inlet 126 extends radially outwardly from the inner point 113 of the second end 138 of the fluid inlet 126 to an outer radial point 146 of the wall 144. The radially extending wall 144 has an annular surface 148 that faces in a direction away from the first end 132 of the fluid inlet 126 and slopes in a direction from the inner point 113 of the second end 138 of the fluid conduit 126 toward the outer radial point 146 of the wall 144. The direction of the slope of the annular surface 148 is oriented toward the first end 132 of the fluid inlet 126 and oriented away from the back shroud 112 of the impeller 110.

As shown in FIG. 3, the angle X of the slope, as measured between a first plane 168 in which the inner point 113 of the second end 138 of the fluid inlet 126 lies and a second plane 170 in which the annular surface 148 of the radially extending wall 140 lies, from the point 149 of the annular portion 147 to the outer radial point 146, is any degree between two degrees and twenty degrees. The first plane 168 is perpendicular to the longitudinal axis of the fluid inlet body or rotational axis 172 of the impeller 110.

The angle X at which the annular surface 148 of the radially extending wall 144 slopes may be, for example, from between four degrees and eighteen degrees; or may be from between five degrees and fifteen degrees; or may be between six degrees and sixteen degrees; or may be between eight degrees and fourteen degrees; or may be between ten degrees and twelve degrees.

The annular outward facing surface 122 of the front shroud 114 of the impeller 110, as shown in FIG. 3, is positioned adjacent to the annular surface 148 of the radially extending wall 144 of the fluid inlet 126 and is, therefore, similarly angled to provide an angled radial gap 162. Consequently, the angle of slope of the outward facing surface 122 of the front shroud 114 is any degree between two degrees and twenty degrees, relative to plane 68, and may be, for example, from between four degrees and eighteen degrees; or may be from between five degrees and fifteen degrees; or may be between six degrees and sixteen degrees; or may be between eight degrees and fourteen degrees; or may be between ten degrees and twelve degrees. The angle of the outward facing surface 122 need not be strictly similar to the slope of the adjacent annular surface 148, but is approximately the same degree. By "approximately" is meant that the degree of angle of the outward facing surface 122 and the degree of slope of the annular surface 148 may be within one to four degrees of each other, resulting in a radial gap 162 that is not of equally spaced dimension as between the outer peripheral area of the gap and the area of the gap closer to the eye of the impeller.

As shown in the embodiment depicted in FIG. 4, the angle X of the slope, as measured between a first plane 168 in which the inner point 113 of the second end 138 of the fluid inlet 126 lies and a second plane 170 in which the entire annular surface 148 of the radially extending wall 140 lies, from the inner point 113 of the annular portion 147 to the outer radial point 146, is any degree between two degrees and twenty degrees. The first plane 168 is perpendicular to the longitudinal axis of the fluid inlet body, or the rotational axis 172 of the impeller 110. The angle X at which the annular surface 148 of the radially extending wall 144 slopes in FIG. 4 may be, for example, from between four degrees and eighteen degrees; or may be from between five degrees and fifteen degrees; or may be between six degrees and sixteen degrees; or may be between eight degrees and fourteen degrees; or may be between ten degrees and twelve degrees. The annular outward facing surface 122 of the front shroud 114 of the impeller 110, as shown in FIG. 4, is positioned adjacent to the annular surface 148 of the radially extending wall 144 of the fluid inlet 126 and is, therefore, similarly angled to provide an angled radial gap 162, as described with respect to the embodiment of FIG. 3.

The angles and slopes of the annular surface of the radially extending wall of the fluid inlet and the annular outward facing surface of the front shroud, as shown in FIGS. 3A, 11 and 12 are also configured with the angle and/or slope dimensions as described with respect to FIGS. 3 and 4.

FIG. 5 illustrates one embodiment of a suction inlet arrangement 176 in accordance with a further aspect of the disclosure where the impeller 110 has a hub 178 configured to be connected to a drive mechanism (not shown) and the impeller 110 has a rear shroud 112 and a front shroud 114 that is axially spaced from the rear shroud 112. The front shroud 114 has a circumferential opening 116 defining an eye 118 of the impeller 110 and has an annular peripheral aspect 120 radially spaced from the eye 118. The front shroud 114 has an outward facing surface 122 that extends from the circumferential opening 116 to the peripheral aspect 120 located at the periphery of the front shroud 114, and the outward facing surface 122 is oriented in a direction away from the rear shroud 112. In the suction inlet arrangement of FIG. 5, the front shroud 114 is devoid of expeller vanes.

The suction inlet arrangement 176 of FIG. 5 also has a fluid inlet body 180 that includes an axially extending fluid conduit 130 having a first end 132 with a first opening 134 for introduction of fluid into the conduit 130, and a second end 138 with a second opening 140. A fluid pathway 182 is defined between the first end 132 and the second end 138. A radially extending wall 144 extends radially outwardly from the second end 138 of the fluid inlet body 180 to an outer radial point 146. The radially extending wall 144 has an annular surface 148 that faces in a direction that is oriented away from the first end 132 of the fluid inlet body 180. The annular surface 148 slopes, from the second opening 138 of the fluid conduit body 180 toward the outer radial point 146, in a direction that is oriented toward the first end 132 of the fluid inlet conduit body 180. Thus, the annular surface 148 presents a configuration that is a frustum.

The outward facing surface 122 of the front shroud 114 is positioned adjacent to the annular surface 148 of the radially extending wall 144 of the fluid inlet body 180 and is angled at approximately the same degree of slope as the angle of slope of the annular surface 148 of the radially extending wall 144. Consequently the outer facing surface 122 of the front shroud 114 has an inverted slope or concave configuration, thereby producing an angled radial gap 162 therebetween. The angle of slope of the outward facing surface 122 of the front shroud 114 is any degree between two degrees and twenty degrees, and may be, for example, from between four degrees and eighteen degrees; or may be from between five degrees and fifteen degrees; or may be between six degrees and sixteen degrees; or may be between eight degrees and fourteen degrees; or may be between ten degrees and twelve degrees.

Figure 6:
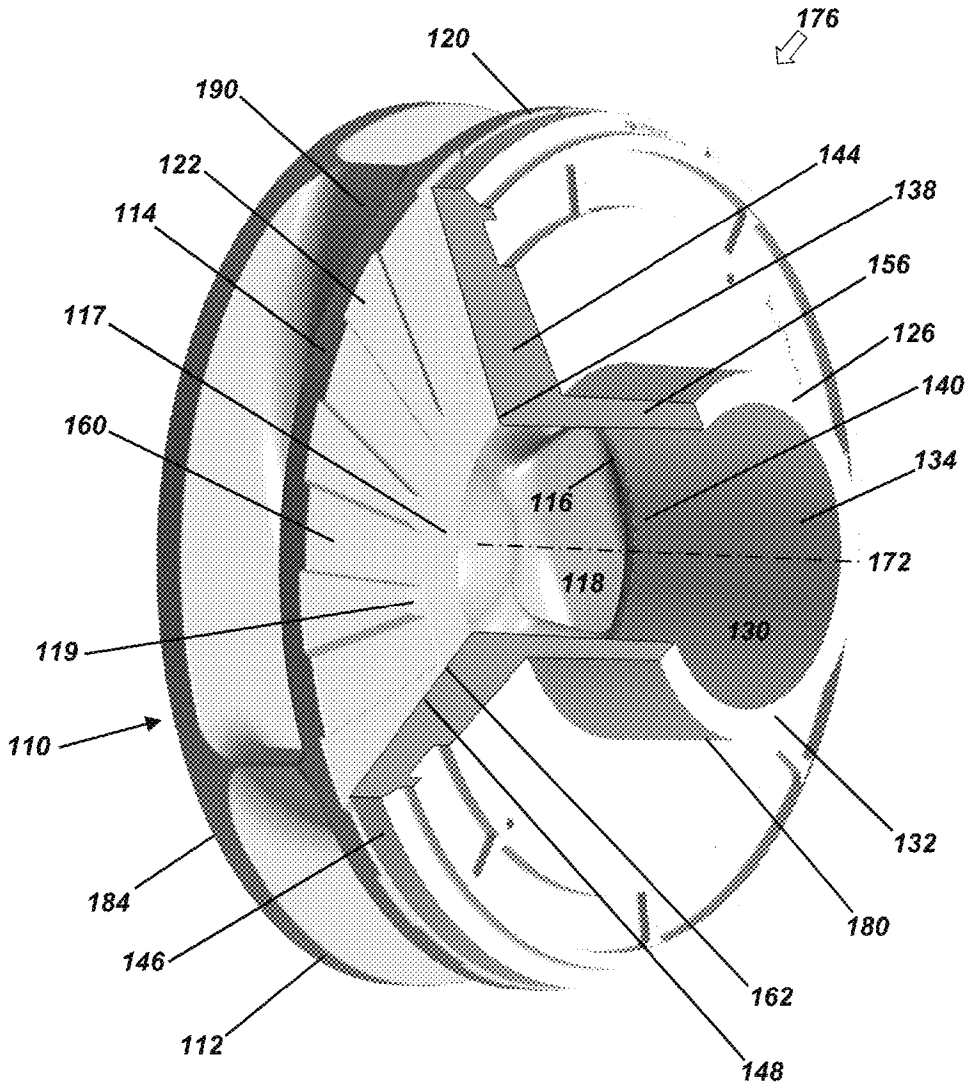
FIG. 6 is an orthographic view in partial cross section of an embodiment of the radial gap shown in FIG. 3.
Figure 7:
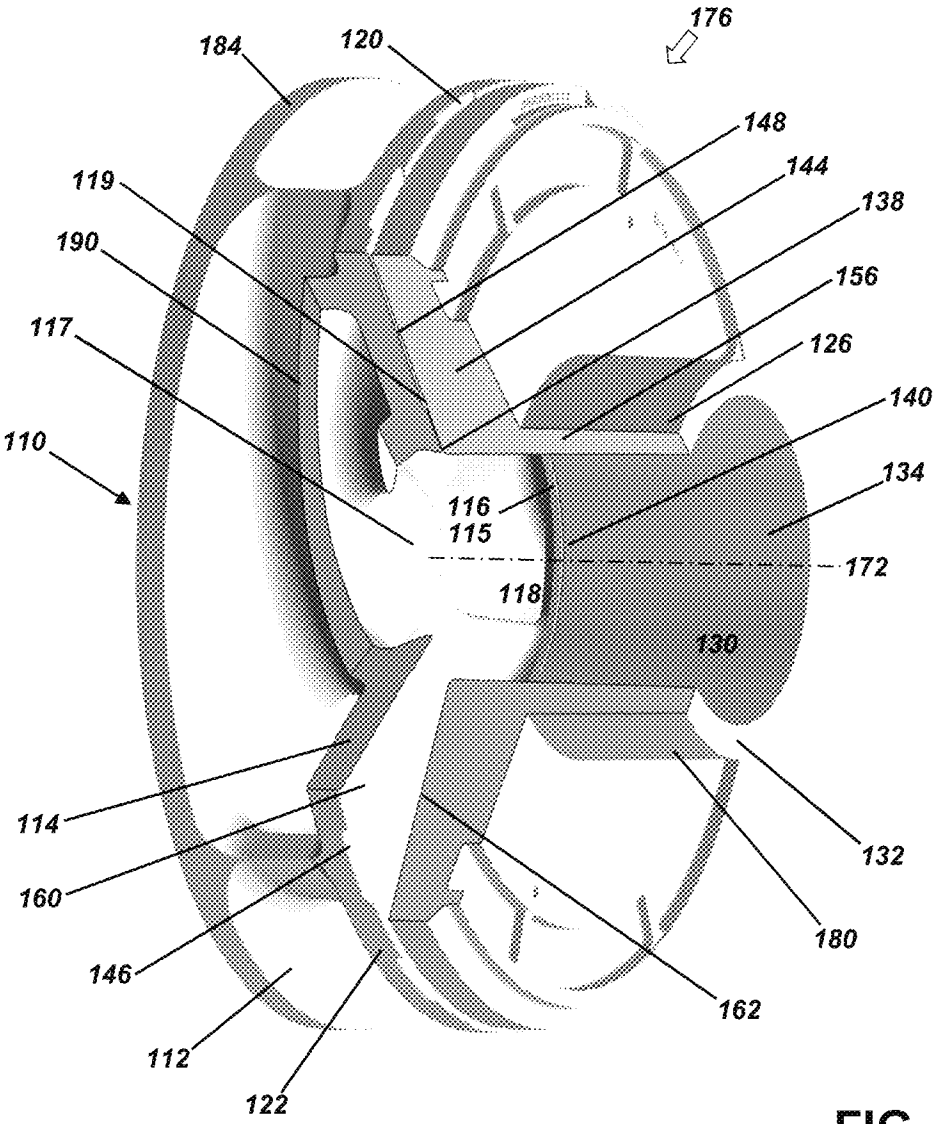
FIG. 7 is an orthographic view in partial cross section of the embodiment of suction inlet arrangement shown in FIG. 6.

FIG. 6 depicts an alternative embodiment of a suction inlet arrangement 176 where like elements or structures are designated with the same reference numerals. The embodiment of the suction inlet arrangement 176 shown in FIG. 6 differs from that shown in FIG. 5 by having expeller vanes 160 arranged on the front shroud 114 of the impeller 110. FIG. 7 depicts a further view of the alternative embodiment of the suction inlet arrangement of FIG. 6. It can be seen in FIG. 7 that the front shroud 114 of the impeller 110 is inverted or sloped such that the front shroud 114 has a concave configuration.

Figure 8:
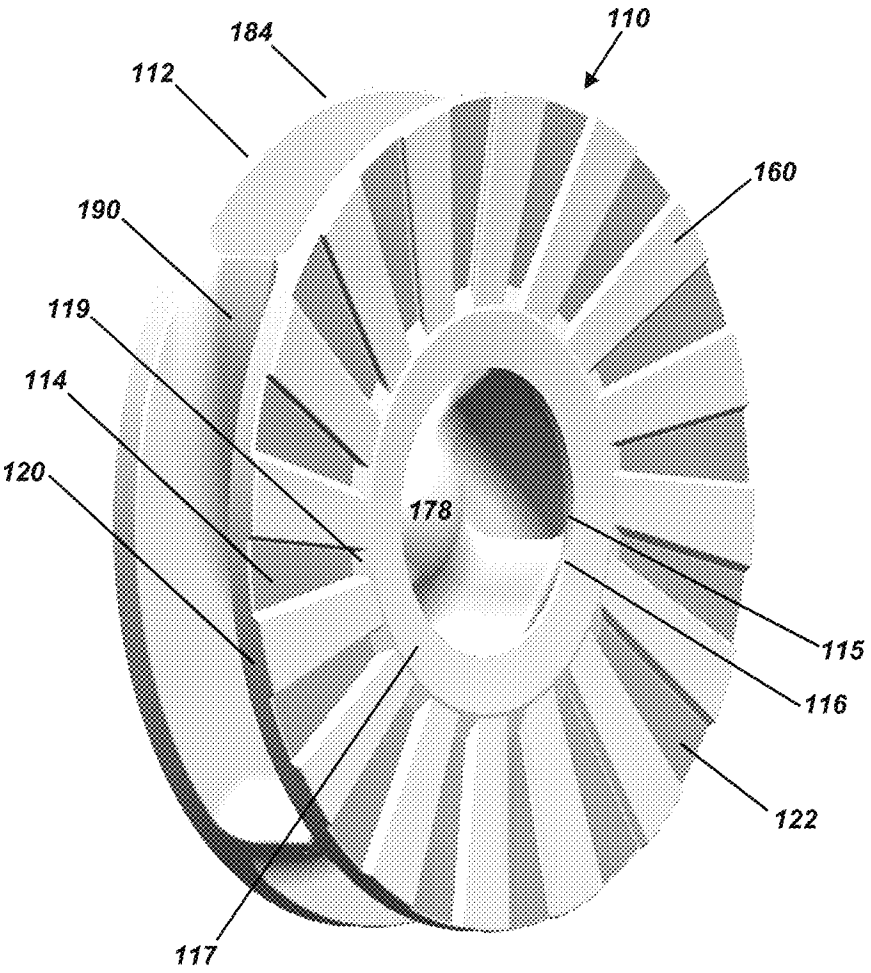
FIG. 8 is a perspective view of an impeller in accordance with one aspect of the disclosure.

In accordance with another aspect of the disclosure, FIG. 8 depicts an impeller 110 for use in a centrifugal pump. The impeller 110 has a hub 178 configured to be connected to a drive mechanism (not shown). The impeller 110 further includes a rear shroud 112 positioned for orientation toward the drive side of a pump. The rear shroud 112 has a peripheral aspect 184 positioned radially from the hub 178, and has a front shroud 114 axially spaced from the rear shroud 112 and positioned for orientation toward the suction side of a pump. The front shroud 114 has a circumferential opening 116 having and edge 115 that defines an eye 118 of the impeller 110. The front shroud 114 has a peripheral aspect 120 radially spaced from the eye 118.

At least one pumping vane 190 extends axially between the rear shroud 112 and the front shroud 114 and extends generally radially from proximate the eye 118 to the periphery the back shroud 112 and/or front shroud 114. The front shroud 114 has an outward facing surface 122 configured to be positioned toward a portion of a pump fluid inlet. The outward facing surface 122 extends from the edge 115 of the circumferential opening 116 to the peripheral aspect 120 of the front shroud 114 at an angle that slopes from the edge 115 to the peripheral aspect 120 of the front shroud 114 in a direction away from the hub 178. That is, the axial distance between the edge 115 and the hub 178 is less than the axial distance between the peripheral aspect 120 and the hub 178. The outward facing surface 122, therefore, presents an inverted on concave profile.

Figure 9:
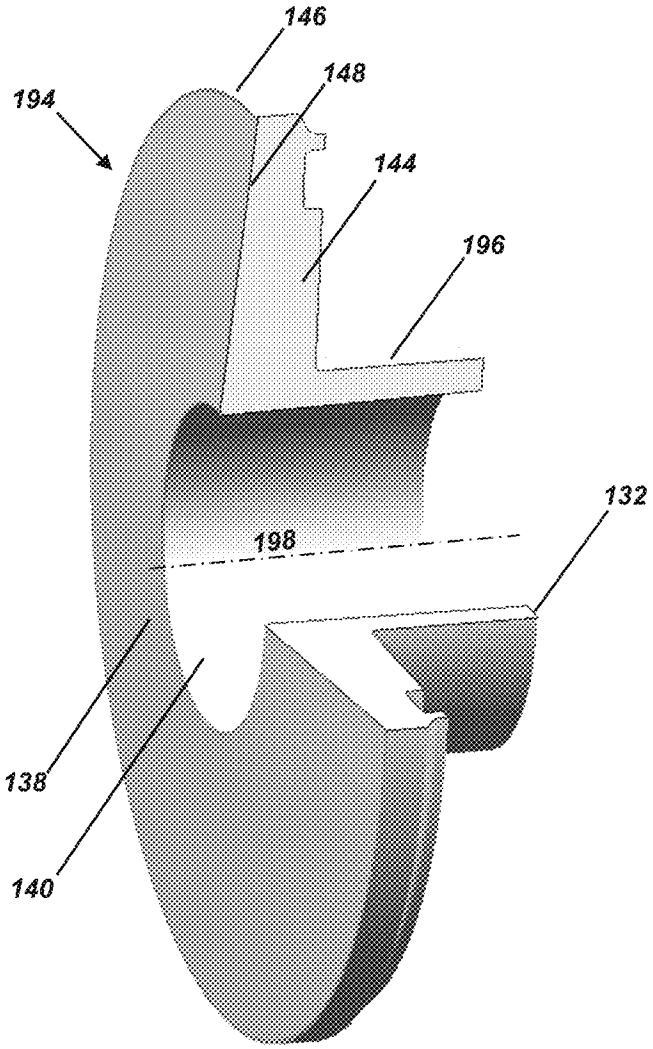
FIG. 9 is a perspective view of a fluid inlet body in accordance with one aspect of the disclosure.

FIG. 9 depicts a pump casing element 194 for a centrifugal pump in accordance with another aspect of the disclosure. The pump casing element 194 includes a fluid inlet conduit 196, having a first end 132 with a first opening 130 (FIGS. 3 and 4) for introduction of fluid into the conduit 196, and a second end 138 with a second opening 140 for delivery of fluid to an impeller. A fluid pathway 198 is provided between the first end 132 and the second end 138. A radially extending wall 144 extends radially outwardly from the second end 138 of the fluid inlet conduit 196 and extends from the second opening 138 of the fluid inlet conduit 196 to an outer radial point 146 of the wall 144 of the pump casing element 196. The radially extending wall 144 has an annular surface 148 that faces outwardly in a direction that is oriented away from the first end 132 of the fluid inlet conduit 196. The annular surface 148 slopes in a direction from the second end 138 of the fluid inlet conduit 196 to the outer radial point 146, the direction of the slope being oriented toward the first end 132 of the fluid inlet conduit 196.

The angle of the slope, as measured between a first plane 168 (shown in FIG. 4 and being perpendicular to the rotational axis 172) in which the second end 138 of the fluid inlet 126 lies and a second plane 170 in which the annular surface 148 of the radially extending wall 140 lies, is any degree between two degrees and twenty degrees. The angle of slope may be, for example, from between four degrees and eighteen degrees; or may be from between five degrees and fifteen degrees; or may be between six degrees and sixteen degrees; or may be between eight degrees and fourteen degrees; or may be between ten degrees and twelve degrees. The sloped annular surface 148 is configured, therefore, as a frustum.

Figure 10A:
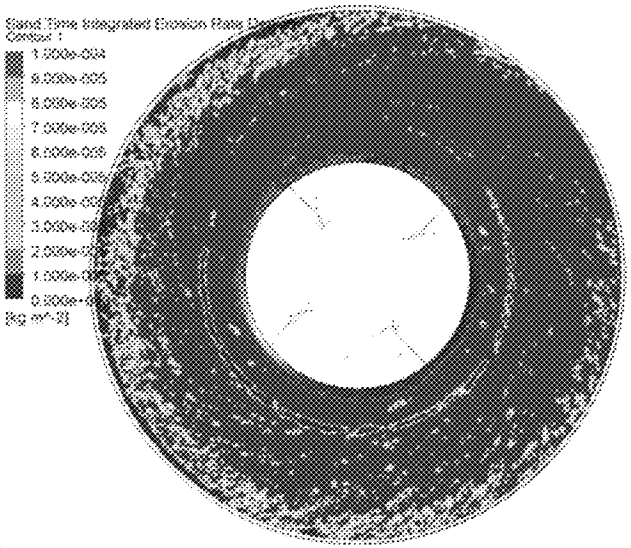
FIG. 10A depicts an analysis of wear on the side liner of a pump that has a conventional planar gap geometry.
Figure 10B:
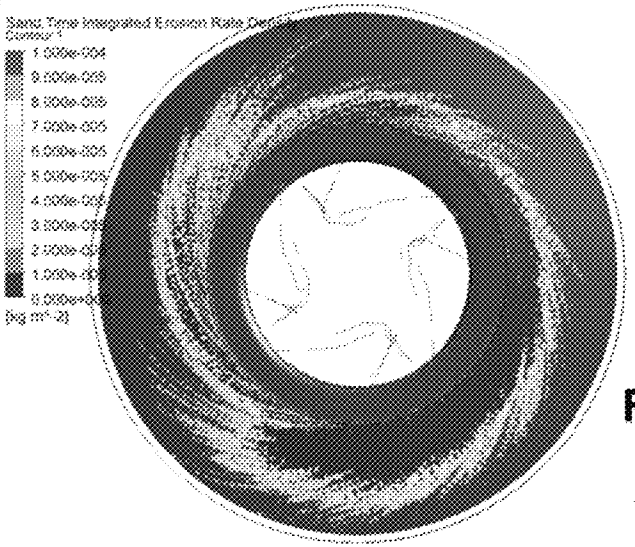
FIG. 10B depicts an analysis of wear on the side liner of a pump that has a conventional sloped gap geometry.
Figure 10C:
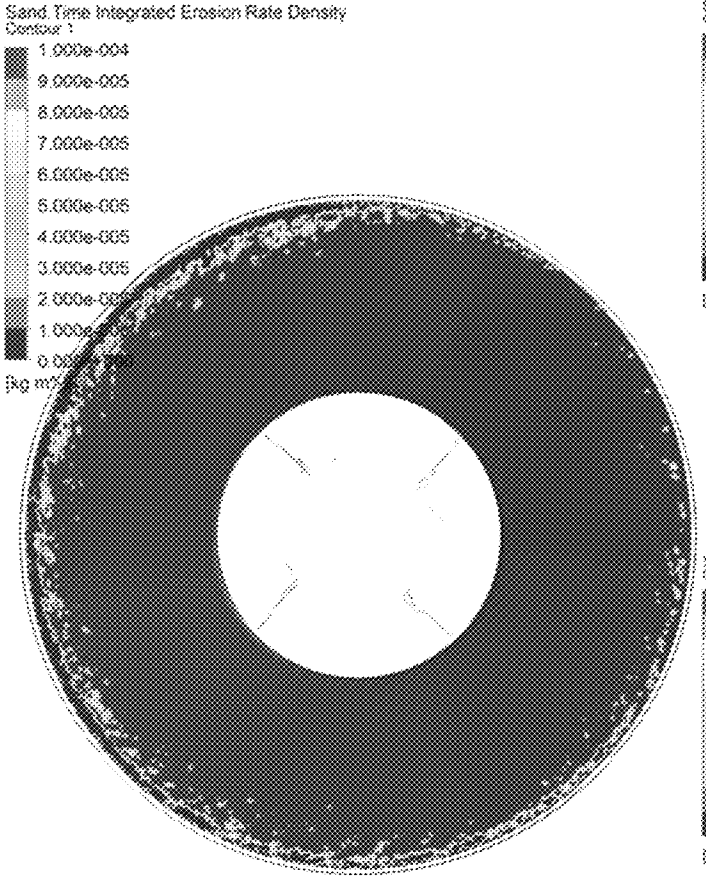
FIG. 10C depicts an analysis of wear on the side liner of a pump that is configured in accordance with the present disclosure.

FIGS. 10A through 10C illustrate, comparatively, wear analyses of the side liner of a pump casing given three types of gap geometry. FIG. 10A depicts the wear that is observed in the side liner of pumps having a planar gap geometry of the type illustrated in FIG. 1. FIG. 10B depicts the wear pattern observed in the side liner of pumps having a conventionally known obtusely-angled gap geometry of the type disclosed in, for example, U.S. Pat. No. 8,834,101. FIG. 10C depicts the wear pattern observed in a side liner having an inverted or acutely sloped gap geometry in accordance with the present disclosure. It can be seen that wear in the side liner, as depicted in FIG. 10C, is significantly reduced as compared to the wear of the side liner observed in conventional gap arrangements, shown in FIGS. 10A and 10B.

In the foregoing description of certain embodiments, specific terminology has been employed for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the inventions, and alterations, modifications, additions and/or changes can be made thereto without departing from the scope and spirit of the disclosed embodiments, the embodiments being illustrative and not restrictive.

Furthermore, the inventions have been described in connection with what are presently considered to be the most practical and suitable embodiments for carrying out the objectives of the disclosure, and it is to be understood that any such invention is not to be limited to the disclosed embodiments, but on the contrary, is intended to cover various modifications and equivalent arrangements included within the spirit and scope of the inventions. Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A suction inlet arrangement for a centrifugal pump, comprising:

a fluid inlet body comprising, an axially extending fluid conduit having a first end with a first opening for introduction of fluid into the conduit and a second end with a second opening, a fluid pathway being defined between the first end and the second end; and a radially extending wall that extends radially outwardly from the second end of the fluid inlet body to an outer radial point that is located for positioning adjacent to a pump casing part in use, the radially extending wall having an annular surface that faces outwardly in a direction away from the first end of the fluid inlet body and which slopes in a direction from at or near the second end of the fluid conduit toward the outer radial point, the direction of the slope being toward the first end of the fluid inlet conduit; and an impeller having a rear shroud and a front shroud axially spaced from the rear shroud, the front shroud having a circumferential opening defining an eye of the impeller and having an annular peripheral aspect at the outer periphery of the impeller radially spaced from the eye, the front shroud having an outward facing surface that extends at or from near the circumferential opening to the annular peripheral aspect of the front shroud and is oriented in a direction away from the rear shroud, the outward facing surface of the front shroud being positioned adjacent to the radially extending wall of the fluid inlet body and being angled at approximately the same degree of slope as the angle of slope of some or all of the radially extending wall of the fluid inlet body, wherein the outer radial point of the radially extending wall is positioned proximate the outer periphery of the impeller.

2. The suction inlet arrangement of claim 1, wherein the angle of slope of the radially extending wall, as measured from a first plane in which the second end of the fluid inlet body lies and a second plane in which the radially extending wall lies, is between two degrees and twenty degrees, between four degrees and eighteen degrees, between five degrees and fifteen degrees, between six degrees and sixteen degrees, between eight degrees and fourteen degrees or between ten degrees and twelve degrees.

3. The suction inlet arrangement of claim 1, wherein the radially extending wall is further configured with an annular portion encircling the second opening of the fluid inlet body, the annular portion extending from the second opening to a boundary point spaced from the second opening to define a portion of a seal dam, and wherein the slope of the radially extending wall is measured from the boundary point of the annular portion spaced from the second opening to the outer radial point of the radially extending wall, and wherein the angle of the slope is measured from a first plane in which the boundary point of the annular portion lies and a second plane in which the sloping radially extending wall lies, the angle of slope being between two degrees and twenty degrees.

4. The suction inlet arrangement of claim 3, wherein the impeller is further configured with a ring-shaped annular base that extends from the circumferential opening of the impeller to a circular facet that is spaced apart from the circumferential opening, the ring-shaped annular base being positioned adjacent to the annular portion of the radially extending wall of the fluid inlet body to form a seal dam therebetween, the space formed between the annular portion and the ring-shaped annular base defining a seal gap.

5. The suction inlet arrangement of claim 4, wherein the seal gap is acutely angled relative to a rotational axis extending through the fluid inlet body.

6. The suction inlet arrangement of claim 4, wherein the seal gap is perpendicular to a longitudinal axis extending through the fluid inlet body.

7. The suction inlet arrangement of claim 1, wherein the outward facing surface of the front shroud further includes at least one expeller vane.

8. The suction inlet arrangement of claim 1, wherein the fluid inlet body is selected from at least one of a group comprising: a throatbush and a side liner component of a pump casing.

9. A pump casing element for use in a centrifugal pump having a suction side pump casing, comprising:

a fluid inlet conduit having a first end with a first opening for introduction of fluid into the conduit and a second end with a second opening for delivery of fluid to an impeller, a fluid pathway being provided between the first end and the second end, a longitudinal axis extending between the first end and the second end; and a radially extending wall that extends radially outwardly from the second end of the fluid inlet conduit and extends from the second end of the fluid inlet conduit to an outer radial point located, in use, for positioning adjacent the suction side casing of the centrifugal pump and in proximity to the outer periphery of an adjacently-positioned impeller, the radially extending wall having an annular surface that faces outwardly in a direction that is oriented away from the first end of the fluid inlet conduit and which slopes in a direction from at or near the second end of the fluid conduit to the outer radial point, the direction of the slope being toward the first end of the fluid inlet conduit.

10. The pump casing element of claim 9, wherein the angle of slope of the radially extending wall, as measured from a first plane in which the second end of the fluid inlet conduit lies and a second plane in which all or some of the radially extending wall lies, is between two degrees and twenty degrees, between four degrees and eighteen degrees, between five degrees and fifteen degrees, between six degrees and sixteen degrees, between eight degrees and fourteen degrees or between ten degrees and twelve degrees.

11. The pump casing element of claim 9, further comprising an annular portion encircling the second opening of the fluid inlet body, the annular portion extending from the second opening to a boundary point spaced from the second opening, and wherein the slope of the radially extending wall is measured from the boundary point of the annular portion spaced from the second opening to the outer radial point of the radially extending wall, and wherein the angle of the slope is measured from a first plane in which the boundary point of the annular portion lies and a second plane in which the sloping radially extending wall lies, the angle of slope being between two degrees and twenty degrees.

12. The pump casing element of claim 9, wherein the fluid inlet conduit and radially extending wall are selected from at least one of a group comprising: portions of a pump casing side of a centrifugal pump, components of a throatbush for a centrifugal pump, components of a side liner for a centrifugal pump.

13. The pump casing element of claim 9, wherein the fluid inlet conduit and radially extending wall are components of an elastomeric wear member.

14. A centrifugal pump, comprising:

a pump casing having a drive side and a suction side, the joinder of which define a pump chamber;

an impeller configured for attachment to a drive mechanism and being rotatably received in the pump chamber, the impeller having a rear shroud and a front shroud, the front shroud having a circumferential opening defining the eye of the impeller and having an outer peripheral aspect at the outer periphery of the impeller, the outer peripheral aspect being radially spaced from the circumferential opening, the front shroud having an annular outward facing surface oriented toward the suction side of the pump casing, the annular outward facing surface being angled, from at or near the circumferential opening of the eye to the outer peripheral aspect, in a direction toward the suction side of the pump casing; and a fluid inlet positioned at the suction side of the pump casing and having a conduit having a first end with a first opening for introduction of fluid into the conduit and a second end with a second opening for delivery of fluid to the eye of the impeller, and further having a radially extending wall that extends radially outwardly from the second end of the conduit and extends from the second opening of the conduit to an outer radial point positioned adjacent the suction side pump casing proximate the outer peripheral aspect of the impeller, the radially extending wall having an annular surface that faces outwardly in a direction that is oriented toward the impeller and which slopes, from at or near the second end of the fluid conduit to the outer radial point, in a direction toward the first end of the conduit.

15. The centrifugal pump of claim 14, wherein the angle of slope of the annular surface of the radially extending wall is between two and twenty degrees.

* * * * *